US007154364B2

(12) United States Patent
Valdemarsson

(10) Patent No.: US 7,154,364 B2
(45) Date of Patent: Dec. 26, 2006

(54) ELECTRICAL MACHINE

(75) Inventor: Stefan Valdemarsson, Linköping (SE)

(73) Assignee: ABB AB, Västerås (SE)

( * ) Notice: Subject to any disclaimer, the term of this patent is extended or adjusted under 35 U.S.C. 154(b) by 36 days.

(21) Appl. No.: 10/502,337

(22) PCT Filed: Jan. 22, 2003

(86) PCT No.: PCT/SE03/00101

§ 371 (c)(1),
(2), (4) Date: May 4, 2005

(87) PCT Pub. No.: WO03/063187

PCT Pub. Date: Jul. 31, 2003

(65) Prior Publication Data

US 2005/0206488 A1 Sep. 22, 2005

(30) Foreign Application Priority Data

Jan. 23, 2002 (SE) ..... 0200179

(51) Int. Cl.
*H01F 27/28* (2006.01)

(52) U.S. Cl. ..... 336/180; 336/182; 336/183

(58) Field of Classification Search ..... 336/180–183
See application file for complete search history.

(56) References Cited

U.S. PATENT DOCUMENTS 4,164,672 A * 8/1979 Flick ..... 310/54
4,176,334 A 11/1979 Buritz et al.
4,864,266 A * 9/1989 Feather et al. ..... 336/150
5,901,433 A * 5/1999 Moon et al. ..... 29/606
6,970,063 B1 * 11/2005 Fromm et al. ..... 336/182
6,980,076 B1 * 12/2005 Rolling et al. ..... 336/207
2003/0164245 A1 * 9/2003 Areskoug ..... 174/110 R

FOREIGN PATENT DOCUMENTS

| | | |
|---|---|---|
| DE | 2905064 A1 | 8/1980 |
| SE | 0003037-9 | 8/2000 |
| WO | WO 97/45847 | 12/1997 |
| WO | WO 98/34245 A1 | 8/1998 |
| WO | WO 02/19353 A1 | 3/2002 |

* cited by examiner

*Primary Examiner*—Anh Mai
(74) *Attorney, Agent, or Firm*—Venable LLP; Eric J. Franklin

(57) ABSTRACT

An electric machine comprises a core (10) of magnetic material and a first insulating layer (14) of a solid electrically insulating material surrounding the core. A high-voltage winding (17) in the form of an electric conductor is wound around a first part (16) of the first insulating layer and a field-equalizing member (19) is arranged around a second part (18) of the first insulation layer. Further, a second insulating layer (20) of a solid electrically insulating material surrounds the high-voltage winding and the field-equalizing member. The field-equalizing member comprises at least one first sub-member in the form of a winding (27, 28, 37, 38), and an electric cable conductor (31) is intended to be connected to the high-voltage winding at the field-equalizing member.

30 Claims, 9 Drawing Sheets

ELECTRICAL MACHINE

TECHNICAL FIELD

The present invention relates to an electrical machine comprising a core of a magnetic material and a high-voltage winding in the form of an electric conductor wound around a first part of the core. The present invention also relates to use of an electrical machine according to the above.

BACKGROUND OF THE INVENTION

Electrical machines comprising a high-voltage winding are used to a large extent in various applications in networks for transmission and distribution of electricity. Examples of non-rotating machines of this kind are transformers and reactors.

High voltage in this context means voltages in excess of 1 kV.

In addition to comprising a high-voltage winding, known transformers also comprise a low-voltage winding, and conventionally the high-voltage winding and the low-voltage winding are arranged around a core of magnetic material. Further, insulating layers are arranged at least between the core and one of the windings and also between the windings. The insulating layers often consist of paper impregnated with oil. One disadvantage of these prior art insulating layers is that they have to be made thick to function satisfactorily. Another disadvantage of handling such layers is that it entails a risk of contamination. These problems can be avoided by using solid insulating layers. One example of a transformer with solid insulation is described in the international application with publication No. WO 97/45847. This transformer has a cable wound around a core of a magnetic material. The transformer solves the problem of leakage of oil that is hazardous to the environment. The same technique may be used for manufacturing other non-rotating electrical machines, such as, for example, reactors.

In many cases there is a relative shortage of space at the locations where a transformer is to be placed. This is true, for example, in those cases where the transformer is to be placed in a densely populated area or inside a building. In such cases, it would be desirable to have a less bulky transformer or a transformer with a geometrical shape that is adapted to the space available. The transformer may then, for example, be located in an existing cable channel, along a wall, or below a roof. In many cases, it is also desirable to provide a transformer with a lower weight, for example when the transformer is to be placed on top of a power-line pylon.

When distributing current to private dwellings, it is desirable to step down the voltage to ordinary mains voltage as late as possible to minimize the losses. Usually, the voltage is then stepped down from a voltage of the order of magnitude of 10 kV to 400 volts. In many countries, it is customary to place such transformers at the top of a pylon. However, because of the size of the transformers, there is a risk that they may blow down, which results in costs as well as maintenance and repair work. Also in this case, it is desirable to minimize the size of the transformer.

In many cases, it is desired to connect a cable to the high-voltage winding on a transformer according to the above. Such a cable conventionally comprises a conductor surrounded by an insulation. The connection of the high-voltage winding to the electric cable may be performed in many different ways. However, it is important to avoid high electric fields during the connection, since these could lead to electrical breakdown.

Thus, there is a need of an electrical machine with smaller dimensions or with a geometrical shape different from that of currently used machines, so that the above-mentioned problems can be avoided while at the same time avoiding high electric fields when connecting a cable to the high-voltage winding.

One example of an electrical machine that solves many of the above-mentioned problems is described in applicant's Swedish application 0003037-9 (not published), which is incorporated herein by reference.

In applicant's above-mentioned application 0003037-9, the connection of the cable is made by inserting the cable between the insulating layers of the transformer, whereby the cable conductor is connected to the high-voltage winding. A problem that arises when making such a connection is the high electric field that may arise in the region where the high-voltage winding is terminated and where the insulation of the transformer changes into the insulation of the cable, that is, in the cable termination. This high electric field may result in electrical breakdown to the outside of the transformer. To control the electric field in the cable termination region, the first and second insulating layers of the transformer have therefore been provided with so-called corona protection layers in the region for the cable connection. These layers have a non-linear resistivity as a function of the electric field, and their function is to equalize the electric field. In certain applications, for example in applications with high-voltage distributions with steep voltage derivatives at high frequencies, it would, however, be desirable to have an alternative to the corona protection layers. The reason for this is that heat is built up in the layers while at the same time the voltage distribution varies for different frequencies.

Thus, there is a need of an electrical machine with a design that differs from that of currently used machines, so that the problems mentioned above can be avoided also in high-voltage applications with steep voltage derivatives at high frequencies.

SUMMARY OF THE INVENTION

It is an object of the present invention to provide an electrical machine that solves at least one of the problems discussed above.

It is another object of the present invention to provide an electrical machine comprising a high-voltage winding that allows a flexible location and that allows connection of an electric high-voltage cable without high electric fields arising in the high-voltage cable when an electric high voltage is applied to the electric machine.

It is a further object of the present invention to provide a use of an electrical machine according to the invention.

At least one of these objects is achieved with an electrical machine and a use according to the appended claims.

An electrical machine according to the invention comprises a core of a magnetic material, a first insulating layer of a solid electrically insulating material surrounding the core, a high-voltage winding in the form of an electric conductor wound around a first part of the first insulating layer, a field-equalizing member arranged around a second part of the first insulating layer, and a second insulating layer of a solid electrically insulating material surrounding the high-voltage winding and the field-equalizing member. The field-equalizing member comprises at least one first sub-member in the form of a winding. An electric cable conductor is intended to be connected to the high-voltage winding at the field-equalizing member.

The electrical machine according to the invention preferably comprises, in addition to a first sub-member, also a second sub-member in the form of a winding.

In those cases where the machine only comprises a winding, the machine is formed so as to surround both the core and the cable conductor when it is connected to the high-voltage winding.

By providing a field-equalizing member in the form of windings, it is possible to avoid electrical flashover when connecting a cable to the machine.

By using a solid insulating material, it is possible to have a considerably smaller distance between the high-voltage winding and the core. This makes possible a considerably smaller electrical machine than what is possible with other types of insulating material, or a machine with considerably better efficiency.

The insulating layers preferably consist of polymer tubes. This permits the tubes to be manufactured in a continuous process by extrusion, which is a well-established manufacturing technique. Alternatively, the insulation may be extruded directly towards the core.

With electrical machines such as, for example, with transformers having an insulation of the type described above, problems sometimes arise, as mentioned above, in the form of a high electric field when connecting an electric conductor. The field-equalizing member in the electrical machine according to the present invention permits control of the electric field in the connection region so that the field does not become too high, thus avoiding electrical breakdown. This means a considerably safer connection between the transformer and the cable, thus greatly reducing the risk of electrical breakdown.

The electric conductor is preferably wound around the core in a substantially tangential direction in relation to the longitudinal axis of the core.

The core preferably has a substantially cylindrical shape, and advantageously a substantially circularly cylindrical shape. This results in the insulating layers preferably having a circular cross section. For practical reasons, however, the shape of the core, and hence also of the insulating layers, may deviate from this shape. The core is advantageously built up of a plurality of plates to avoid eddy currents in the core.

An electrical machine according to the present invention preferably has the first sub-member wound so that it adjoins the outside of the first insulating layer and the second sub-member wound so that it adjoins the inside of the second insulating layer. Since the insulating layers, as mentioned above, preferably have circular cross sections, this means that the two sub-members also preferably have circular cross sections. Further, it can be mentioned that, since the two insulating layers are arranged around the core in spaced relationship to each other, the two sub-members are also arranged in spaced relationship to each other. The two sub-members preferably have the same potential and each of them pulls apart the electric field in an axial direction.

According to one embodiment, the first and second sub-members in an electrical machine according to the present invention are each connected to ground at one end. By connecting one end of the sub-members to ground, the potentials for the sub-members are linked to each other such that the potential for the sub-members is the same in the same position in the longitudinal direction of the machine.

According to another embodiment, said first and second sub-members are each connected to a high-voltage winding at one end.

Preferably, the sub-members are each connected to a ground connection at a first end and to a high-voltage winding at a second end to avoid large voltage derivatives at the ends.

To be able to use the electrical machine, an electric cable conductor must be connected to the high-voltage winding. The connection of the high-voltage winding to the electric conductor may be made in many different ways. An electric cable conductor that is connected to the high-voltage winding is preferably surrounded by a third insulating layer of an electrically insulating material. The conductor is partly arranged between the first and second insulating layers, that is, preferably between said first and second sub-members.

When the electrical machine according to the present invention is connected to an ac voltage, there is a magnetic flux in the core. The magnetic flux may be used in connection with an inductive field-equalizing member to control the electric field. In that case, the fact that a voltage is induced across a loop, which occurs in a magnetic field, is made use of.

The field-equalizing member is preferably integrated with the electrical machine.

According to one embodiment, the field-equalizing member, instead of being integrated with the electrical machine, may constitute one unit with the cable, this unit being inserted into the transformer when connecting the cable.

For the best possible inductive control of the electric field, the number of winding turns for said first and second sub-members is preferably the same.

Further, the number of winding turns for said first and second sub-members according to a preferred embodiment of the present invention is chosen so that the voltage induced across each sub-member becomes the same as that across the high-voltage winding. This means that the number of winding turns for the high-voltage winding is the same as for the two sub-members. Since the magnetic flux in the core is common to the two sub-members, each turn therein will have the same turn voltage. This results in an essentially linearly decreasing voltage distribution in the connection region while at the same time resistive power losses are avoided because of a net voltage in the sub-members.

The sub-members preferably each comprise a lacquered wire. For that reason, it is possible to use ordinary electric wire in the sub-members.

An alternative to the preferred embodiment above, in which the field-equalizing member is inductive, is to use a capacitive field-equalizing member.

In the case of the capacitive field-equalizing member, said first and second sub-members preferably each comprise a tape wound in overlapping turns so that a capacitive coupling is formed between each turn. The electric field can then be controlled by distributing the voltage across the turns so that it is reduced as the distance from the high-voltage winding increases.

In a capacitive field-equalizing member according to the present invention, the tapes can be wound in different ways to achieve different pitches for different parts of the sub-members. The tapes are preferably wound so that a substantially linear voltage distribution is achieved over the length of the sub-members, which means that the voltage across each turn is of the same magnitude.

For the field-equalizing member to function capacitively, tapes comprising an insulating film and a semiconducting film are preferably used. According to a preferred embodiment, the insulating film is arranged on top of the semiconducting film. When a tape with that construction is wound in over-lapping turns, a winding is obtained consisting of semiconducting regions separated by insulating regions.

However, a capacitive winding according to the above will also function as a coil. To avoid resistive losses, the number of winding turns in the sub-members must therefore be adapted to the number of winding turns in the high-voltage winding in the same way as in the case of the inductive field-equalizing member. The number of winding turns in the high-voltage winding is, however, large. For that reason, the sub-members in the capacitive field-equalizing member will be so space-demanding that it will be impracticable, and therefore the inductive field-equalizing member is to be preferred to the capacitive one.

An alternative to the tape according to the above is a tape comprising a metallized film with regular interruptions in the metallization in the longitudinal direction of the film. With a tape according to this embodiment, no resistive losses occur, so this kind of metallized film is to be preferred to an insulating film on top of a semiconducting film.

When manufacturing the electrical machine, it is difficult to avoid air pockets between each of the insulating layers and the high-voltage winding. If there are air pockets, corona will arise, which in course of time may break down the insulating layer. This is a problem that arises primarily at voltages in excess of 1–2 kV and in particular at voltages in excess of 10 kV. One way of avoiding the problem is to use, in the insulating layers, a material that withstands corona. However, it is difficult to find materials that are resistant to corona while at the same time having a high electrical strength.

To derive the greatest possible advantage from the fact that a solid insulating material is used also at high voltages, it is therefore advantageous for the electrical machine also to comprise a first semiconducting layer that is in contact with and surrounded by the first insulating layer, a second semiconducting layer provided between the first insulating layer and the high-voltage winding in contact with both the first insulating layer and the high-voltage winding, a third semiconducting layer provided between the second insulating layer and the high-voltage winding in contact with both the second insulating layer and the high-voltage winding, and a fourth semiconducting layer that is in contact with, and surrounds, the second insulating layer.

For the best possible function, it is important that the semiconducting layers be in contact with the respective insulating layers.

When an electrical machine according to the present invention is connected to a voltage source that delivers a voltage with steep voltage derivatives, the voltage distribution across the high-voltage winding becomes greatly non-linear. The reason for this is that those turns of the high-voltage winding that are closest to the voltage connection must take up a very large part of the total voltage. For this reason, the electrical machine according to the present invention is preferably provided with a flux-shielding member, the task of which is to control the magnetic flux in the core.

The flux-shielding member surrounds the core and is preferably arranged between the core and the first insulating member, preferably between the core and the first semiconducting member.

The flux-shielding member preferably comprises a tube of an electrically conducting non-magnetic material, the tube being arranged inside the first insulating layer and surrounding and being in contact with or adjacent to the core. When the electrical machine is loaded with a voltage, a current moves through the high-voltage winding and there is a magnetic flux in the core. Induced currents are formed in the tube and these currents prevent the magnetic flux from leaking out of the core and force it to follow that part of the core which is surrounded by the tube. This results in an essentially linear distribution of the voltage across the core.

The tube that surrounds the core preferably has a slit along the entire length of the tube to prevent the electrical machine from being short-circuited.

The above-mentioned tube is preferably of aluminium since aluminium has the necessary properties described above and, in addition, is light and ductile. However, the tube could be of any other non-magnetic metal, such as copper.

Preferably, a slit-insulating film of an electrically insulating material is arranged in the above-described slit in the tube, in order to ensure that no electrical contact may arise between the longitudinal, slitted edges of the tube if the slit is compressed. The material is, for example, some electrically insulating plastic. Further, a metal foil of a non-magnetic metal is preferably arranged over said slit and slit-insulating film to prevent a local flux leakage at the slit. The metal foil is in contact with the tube on one of the sides of the slit.

The metal foil is advantageously at least as thick as the depth of penetration at the frequency in question.

It is advantageous for the overlap to be so large that the leakage at the slit is minimized.

According to an advantageous embodiment, the metal foil surrounds between 10% and 25% of the circumference of the electrical machine.

From the point of view of leakage, there is little to gain in allowing the metal foil to surround more than 25% of the circumference of the electrical machine.

An electrical machine with three parallel cores and windings according to the invention may advantageously be used for transformation of three-phase high voltage into mains voltage.

According to one embodiment, an electrical machine according to the invention is used, operating under a square voltage, as in applications with high-voltage direct current.

According to another embodiment, an electrical machine according to the invention is a reactor.

The above characteristic features may, of course, be combined in the same embodiment.

To further illustrate the invention, detailed embodiments of the invention will be described in the following. However, the invention should not be considered to be limited to these embodiments.

DESCRIPTION OF THE PREFERRED EMBODIMENTS

Figure 1:
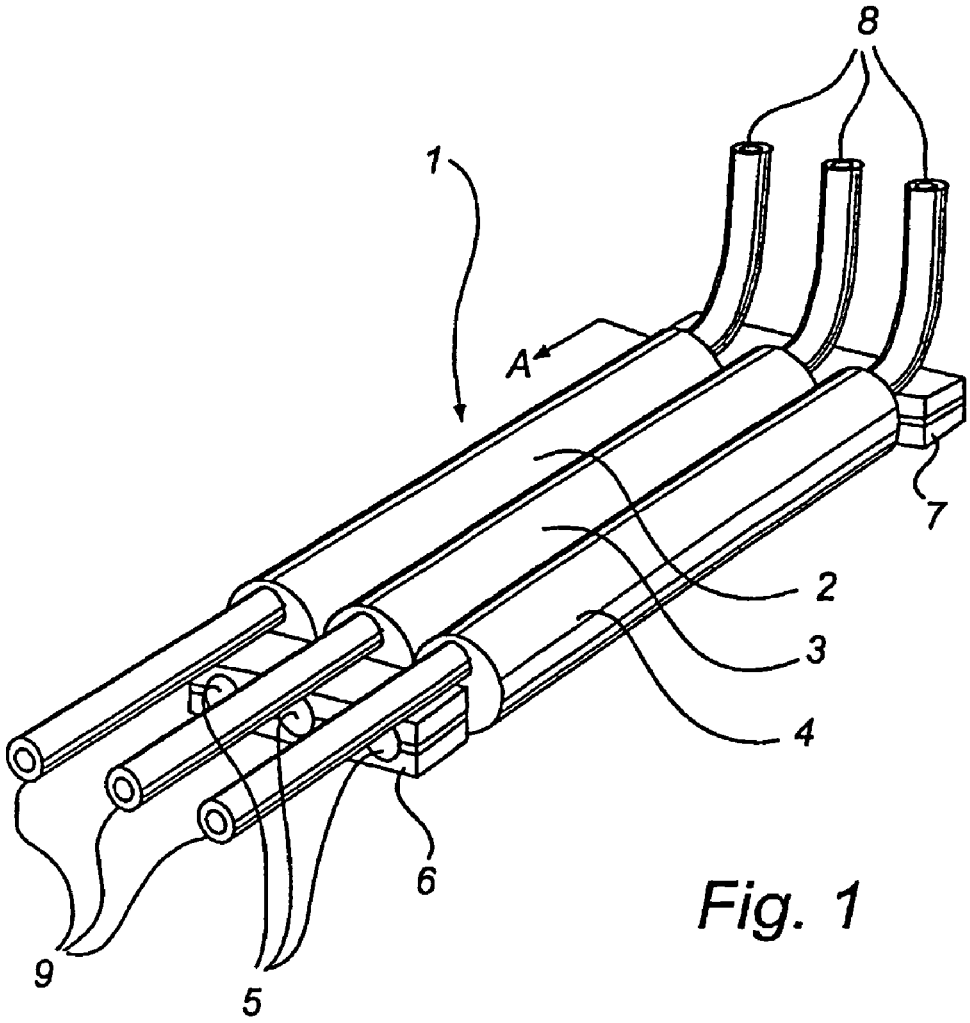
FIG. 1 shows an electrical machine with three interconnected cores according to a preferred embodiment of the present invention.

FIG. 1 shows an electrical machine according to a preferred embodiment of the present invention in the form of a three-phase transformer 1 comprising three single-phase transformers 2, 3, 4. The cores 5 of the single-phase transformers are connected to yokes 6, 7 at both ends. High-voltage cables 9 are connected to high-voltage windings in the single-phase transformers and low-voltage cables 8 are connected to low-voltage windings in the single-phase transformers. The transformer in FIG. 1 is considerably more elongated than conventional transformers and may therefore be located in long and narrow spaces, such as cable channels and the like.

Figure 2:
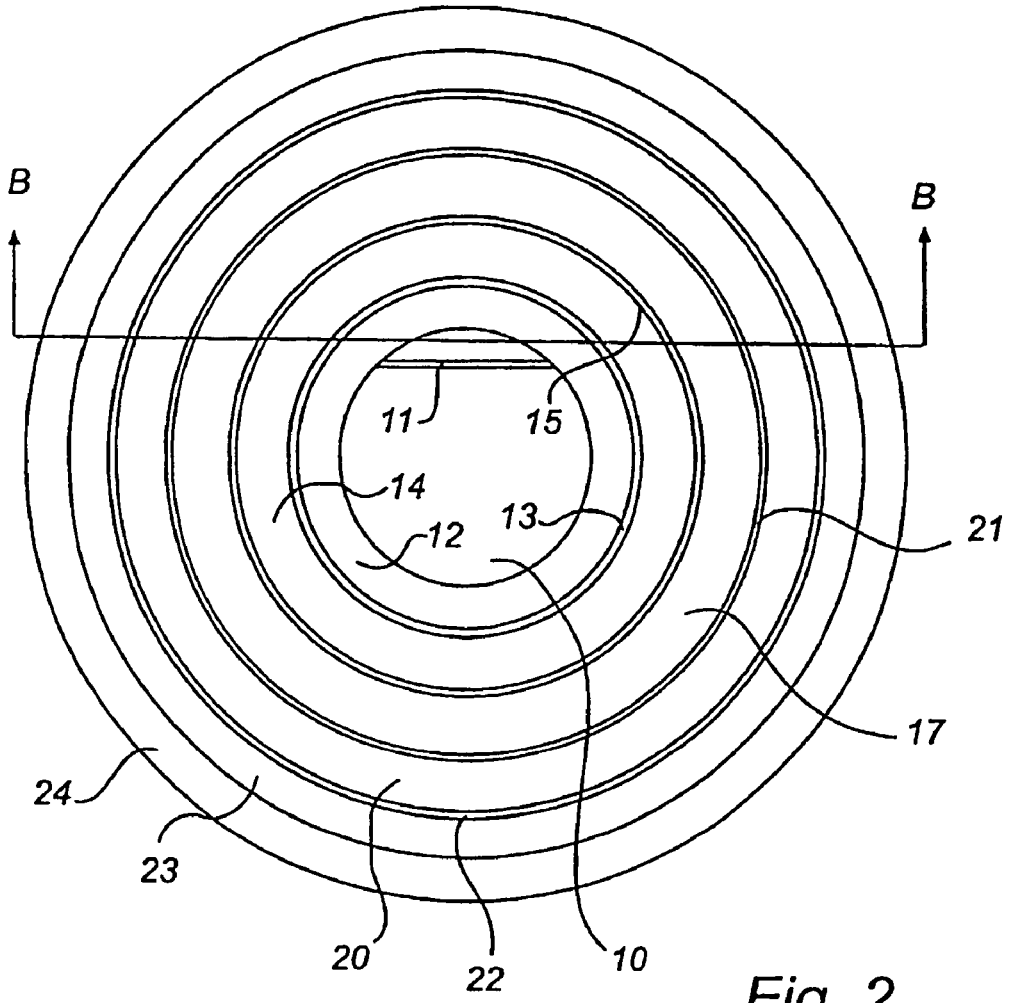
FIG. 2 is a cross-section view at A of part of the electrical machine according to the preferred embodiment of the present invention shown in FIG. 1.
Figure 3:
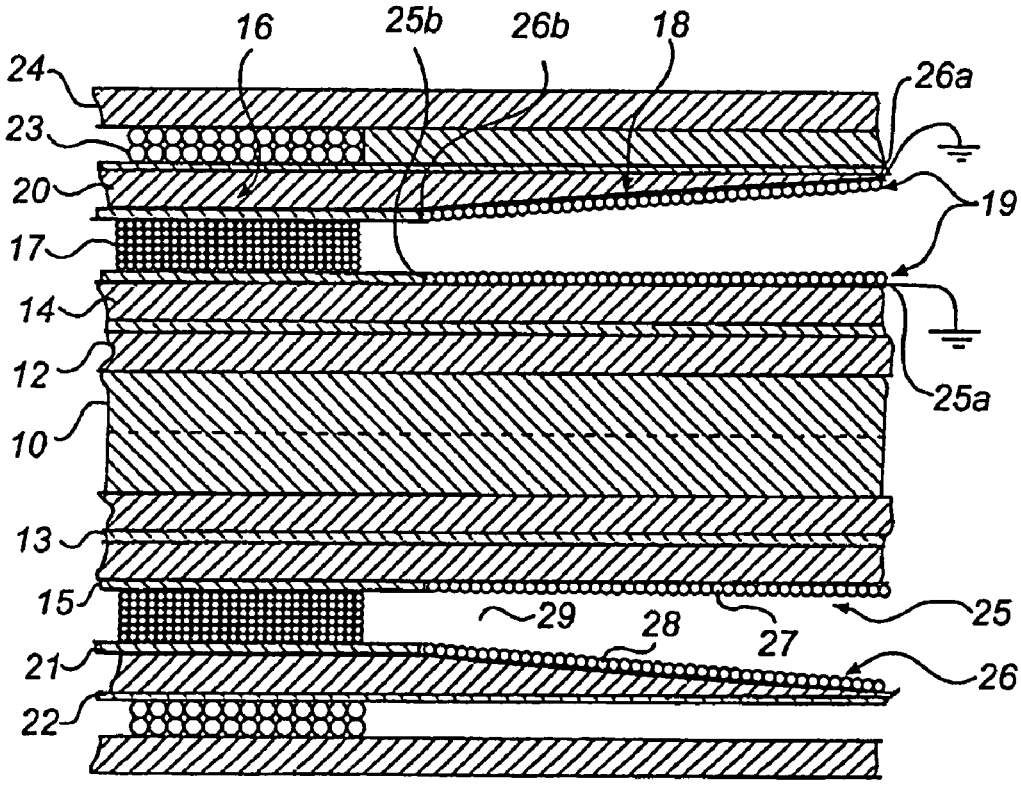
FIG. 3 is a cross-section view at B in FIG. 2.

FIG. 2 shows a cross section of one of the single-phase transformers 2, 3, 4 at A in FIG. 1. FIG. 3 shows a cross section of the same single-phase transformer at B in FIG. 2. The transformer is a high-voltage transformer operating under a square voltage. The single-phase transformer comprises an iron core 10 that is built up of a plurality of sheets 11 extending in the longitudinal direction of the iron core perpendicular to the plane of the figure. For the sake of clarity, only one sheet 11 is shown in FIG. 2. The iron core 10 is surrounded by a flux shield in the form of an aluminium tube 12, the function of the flux shield being to control the magnetic flux in the core. A first semiconducting layer 13 surrounds the aluminium tube 12. The layer 13 is surrounded in its turn by a first insulating layer 14 of a polymer. A first part 16 of the first insulating layer 14 is surrounded by a second semiconducting layer 15, and around this layer a high-voltage winding 17 in the form of an electric conductor is wound. The high-voltage winding 17 preferably consists of a lacquered copper wire. Around a second part 18 of the first insulating layer 14, a field-equalizing member 19 is arranged. The function of the field-equalizing member 19 is to control the electric field in the termination of the transformer, that is, the region where an external connection cable is to be connected, and this region has no high-voltage winding. The high-voltage winding 17 is coated with a third semiconducting layer 21. The field-equalizing member 19 and the third semiconducting layer 21 are in their turn surrounded by a second insulating layer 20 of a polymer, this layer being coated with a fourth semiconducting layer 22 on its outside. In this embodiment, the second insulating layer 20 is chamfered in the region for the termination 18 of the transformer, such that the thickness of the second insulating layer decreases with the distance from the high-voltage winding, which facilitates the connection of an external connection cable. However, there are several other possible embodiments of the second insulating layer. According to one embodiment, it has a uniform thickness and is extended when connecting the cable. A low-voltage winding 23 and an additional insulating layer 24 are arranged outside the fourth semiconducting layer 22.

The function of the semiconducting layers 13, 15, 21, 22 is to equalize the electric field. The semiconducting layers are arranged as integrated parts of the first insulating layer and the second insulating layer, respectively. They have a surface resistance in the interval of $10^5$ to $10^8\Omega$. This results in a sufficiently high conductivity for equalizing the electric field while at the same time preventing too great losses.

The polymer in the insulating layers is, for example, silicone rubber. The insulating layers are adapted to the voltage for which the transformer is designed, and are in this case approximately 10 mm thick when the transformer is designed for 50 kV. The semiconducting layers consist of the same kind of polymer as the insulating layers, the polymer having become semiconducting by mixing soot particles into it.

In the embodiment in FIG. 3, the termination is inductive. The field-equalizing member 19 consists of two sub-members in the form of thin lacquered wires 25, 26 forming windings 27, 28 around the core. The windings 27 and 28 are wound in the same number of turns around the core. One of the wires, 25, is wound so that the resultant winding 27 adjoins the outside of the first insulating layer 14. The other wire 26 is wound so that the resultant winding 28 adjoins the inside of the second insulating layer 20. According to a preferred embodiment, the windings 27, 28 are cast in silicone so that each of them forms a tubular member. These members are preferably inserted around the core so that they will make contact with the outside of the first insulating layer and the inside of the second insulating layer, respectively. The two windings 27, 28 have the same potential and each of them pulls apart the electric field in an axial direction.

Since the second insulating layer is chamfered, the distance between the two windings varies with the distance from the high-voltage winding. This means that there is a space 29 between the two windings that is largest where the thickness of the second insulating layer is smallest. After the connection of a cable to the transformer, that is, after a cable has been inserted between the first and second insulating layers, the space 29 around the cable is sealed by casting to avoid flashover. One end 25*a*, 26*a* of each of the lacquered wires 25 and 26, respectively, is connected to ground and the other end 25*b*, 26*b* is connected to the high-voltage winding 17. According to one embodiment, the field-equalizing member, possibly in the form of the above-described tubular members, may, instead of being integrated with the transformer, form one unit with the cable, this unit being inserted into the transformer when connecting the cable.

Figure 4:
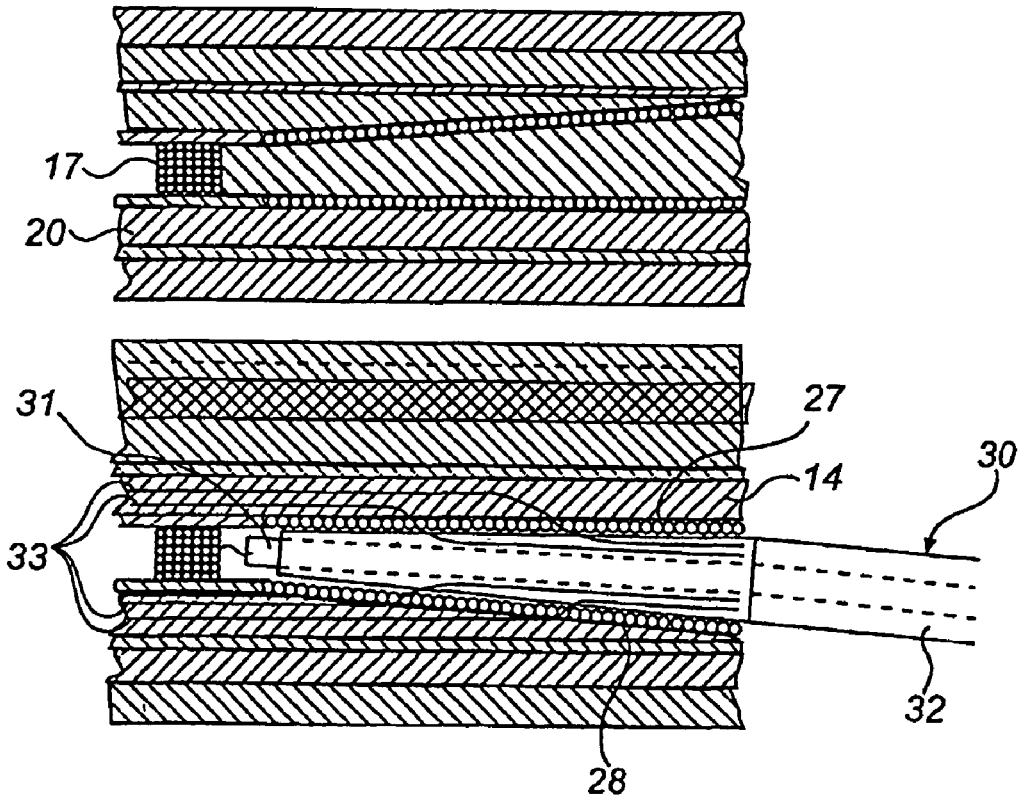
FIG. 4 shows the connection of a cable to an electrical machine according to the preferred embodiment of the present invention.

FIG. 4 shows a connection cable 30 connected to the transformer in FIGS. 2, 3. The connection cable 30 consists of an electric cable conductor 31 that is surrounded by a third insulating layer 32. The conductor 31 is connected to the high-voltage winding 17 of the transformer and is arranged between the first and second insulating layers 14 and 20, respectively. The connection cable 30 has a circular cross section. Its insulating layer 32 is preferably chamfered so that the connection cable 30 has a conical shape at the end that is to be connected to the transformer so that it can be easily inserted into the space 29 between the first and second insulating layers 14 and 20 of the transformer, that is, between the windings 27 and 28.

When a connection cable is to be connected to a known transformer, problems often arise in the form of the high electric field that arises in the region where the insulation of the transformer meets the insulation of the connection cable. The function of the field-equalizing member is to counteract this problem by controlling the electric field.

When a voltage is applied to the transformer in FIG. 4, a current passes through the high-voltage winding. This gives rise to a magnetic flux in the core and to a voltage being induced across the windings 27 and 28. In the field-equalizing member in FIG. 4, the number of winding turns, that is, the number of turns of wire wound around the core, is the same for the two windings 27, 28 and the high-voltage winding. This causes the voltage induced across each of the windings 27, 28 to be the same as the voltage across the high-voltage winding. Since the magnetic flux in the core is common to the two windings, each turn in the windings 27 and 28 will have the same turn voltage. This means that the voltage distribution in the region of the termination will decrease linearly with the distance from the high-voltage winding. This results in a low electric field in the space between the windings, as illustrated by the spaced-apart field lines 33.

Figure 5:
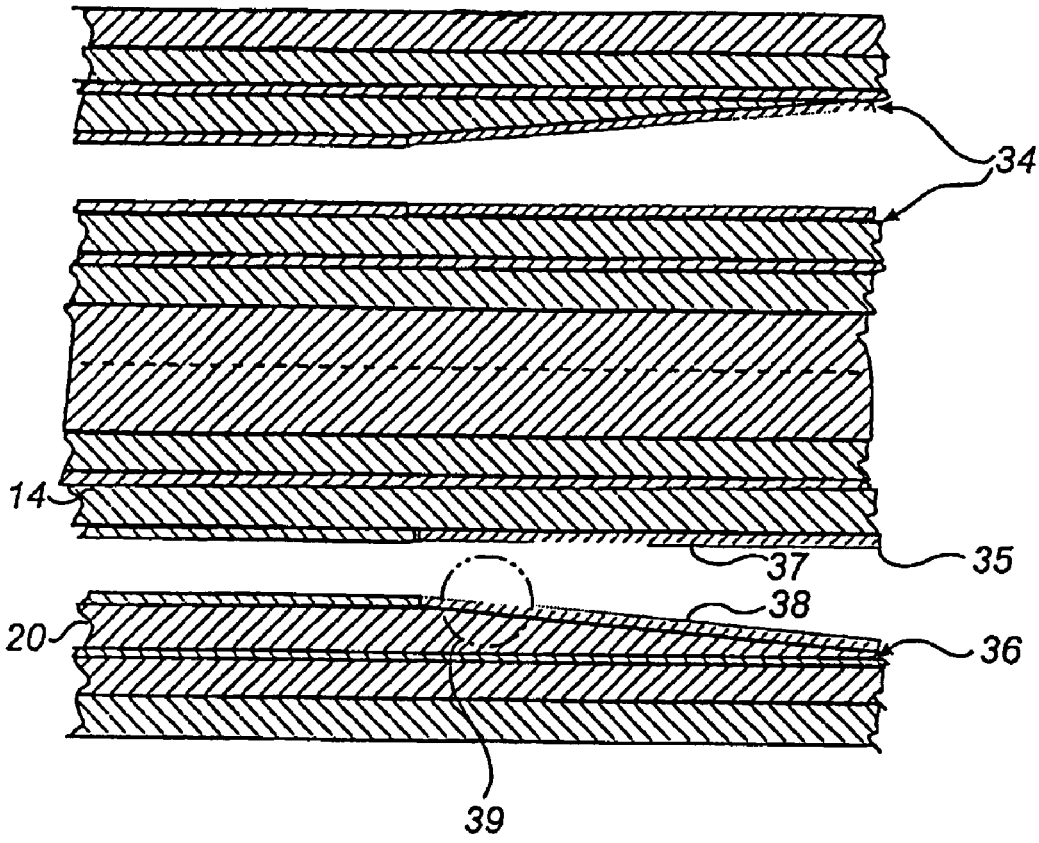
FIG. 5 is a view corresponding to that of FIG. 3 for an alternative embodiment of the present invention.

FIG. 5 shows an alternative embodiment of the present invention in which the termination is capacitive. For the sake of clarity, several details are omitted in the figure. The field-equalizing member 34 in this case consists of two tapes 35, 36 that are wound in concentric, overlapping turns so as to form a capacitive coupling between each turn and windings 37 and 38, respectively, are formed around the core. Just as in the above case, one of the tapes, 35, is wound so that the resultant winding 37 adjoins the outside of the first insulating layer 14. The other tape 36 is wound so that the resultant winding 38 adjoins the inside of the second insulating layer 20. The tapes are wound so closely that an essentially linear voltage distribution across the length of the windings is obtained, and they are connected to ground at one end and to the high-voltage winding at the other end.

Figure 6:
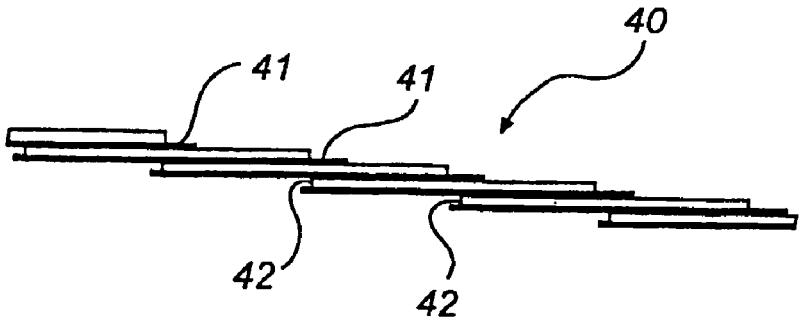
FIG. 6 is an enlargement of a feature in FIG. 5.

FIG. 6 is an enlargement of the region within the dashed circle 39 in FIG. 5 according to one embodiment of the present invention. FIG. 6 shows the resultant winding when a tape 40 has been wound in overlapping turns around the core, this tape consisting of a thin insulating film 41 that is arranged on top of a semiconducting film 42. The resistance for the semiconducting film 42 is chosen to be so low that the capacitive displacement currents do not contribute significantly to the generation of heat in the insulating layers. At the same time, the resistance is chosen to be so high that the turn voltage does not develop too much heat.

The surface resistance for the semiconducting film is thus preferably greater than 10Ω and smaller than 1000Ω. Alternatively, the tape may consist of a metallized film, for example a film coated with aluminium or zinc, this film being provided with regular interruptions in the coating in the longitudinal direction, so-called segmented metallization. With this last embodiment, all losses, such as leakage current, that are associated with the tape in FIG. 6 are avoided.

Figure 7A:
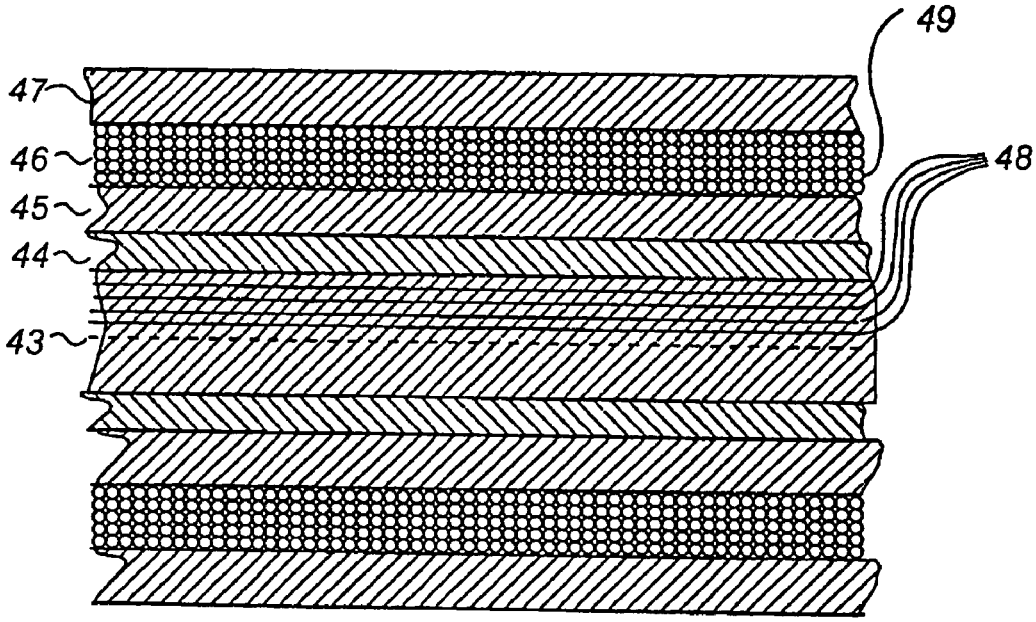
FIG. 7 illustrates how a flux shield according to a preferred embodiment of the present invention functions.
Figure 7B:
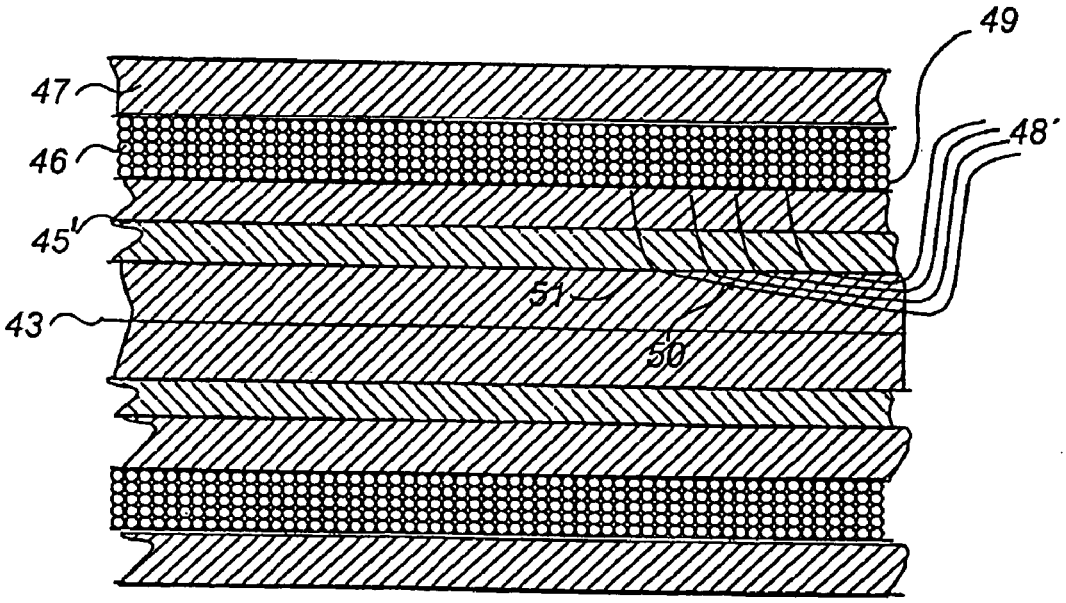

FIG. 7*a* illustrates the function of the flux shield 12 in the preceding figures according to a preferred embodiment of the present invention. FIG. 7*b* shows the result without the flux shield. To clarify the function, the figures are simplified in such a way that some details, for example the semiconducting layers and the field-equalizing member, are omitted. The figures have a core 43 which in FIG. 7*a* is surrounded by a non-magnetic flux shield in the form of an aluminium tube 44, which is omitted in FIG. 7*b*. Instead, a first insulating layer 45' encloses the core in FIG. 7*b*. A first insulating layer 45 encloses the aluminium tube and the core in FIG. 7*a*. A high-voltage winding 46 and then a second insulating layer 47 are then wound around the first insulating layers 45 and 45' in FIGS. 7*a* and 7*b*, respectively. The field lines 48 and 48' illustrate the magnetic flux distribution in the core with, and without, the flux shield 44 when the transformer is connected to a voltage source that delivers a voltage with steep voltage derivatives, for example a square wave. The steep voltage derivatives cause the voltage distribution across the high-voltage winding 46 to become greatly non-linear since those turns of the high-voltage winding that are closest to the voltage connection must absorb a very large part of the total voltage. When the transformer is loaded with a square pulse, a current 49 starts moving through the high-voltage winding. This gives rise to a magnetic flux in the core, and this flux tends to leak out of the core. FIG. 7*b* illustrates how a magnetic sub-flux 50 leaks out of the core at 51. FIG. 7*a* illustrates how the magnetic flux (shown by field lines 48) instead follows the whole core. The flux shield 44 thus controls the magnetic flux by preventing it from leaking out of the core. The current that moves through the high-voltage winding results in a current being induced in the aluminium tube, and the current is distributed in such a way that the flux cannot leak out of the core. Since the magnetic flux cannot pass through the non-magnetic flux shield of aluminium, the flux in the core is equally great everywhere.

Figure 8A:
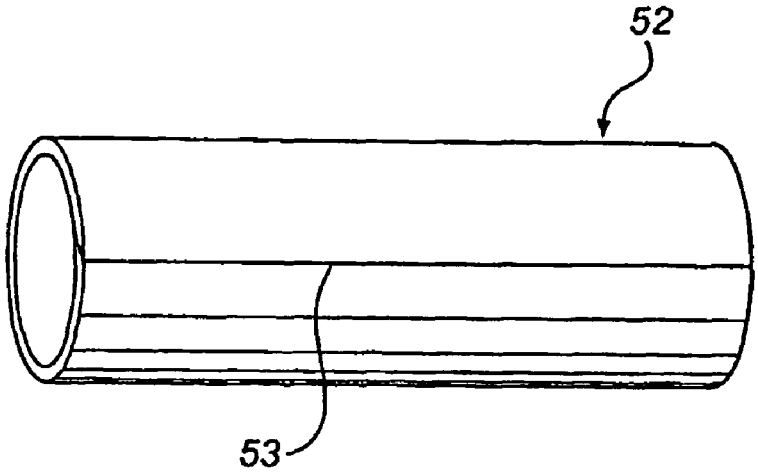
FIG. 8 shows the flux shield according to the preferred embodiment.
Figure 8B:
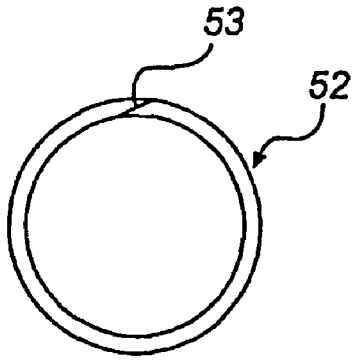
Figure 8C:
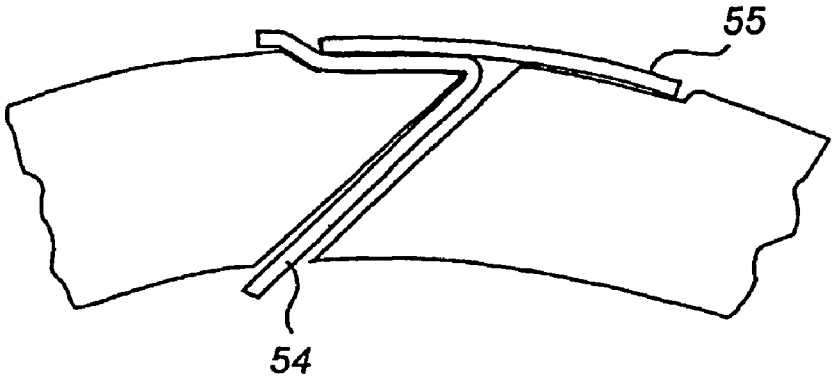

FIG. 8 shows the flux shield according to the preferred embodiment of the present invention on its own. FIG. 8*a* is a perspective view of the flux shield in the form of the aluminium tube 52. The tube 52 is provided with a slit 53 to prevent a transformer according to the above from being short-circuited, the slit being parallel to the centre axis of the tube. FIG. 8*b* shows a cross section of the tube 52 with the slit 53. The figure shows that the slit in the preferred embodiment of the present invention does not pass straight through the wall of the tube. Instead, the slit extends transversely to allow the longitudinal parallel slitted tube edges to overlap each other. FIG. 8*c* shows an enlargement of that part of FIG. 8*b* that shows the slit and the region around it. A slit-insulating film 54 is arranged in the slit to ensure that the parallel tube edges do not make contact with each other. Further, an aluminium foil 55 is arranged so as to cover the slit 53 and the slit-insulating film 54 in order thus to locally minimize the flux leakage at the slit. The aluminium foil 55 is connected to one of the parallel tube edges 56 in the slit. According to one embodiment of the invention, the metal foil is at least as thick as the depth of penetration at the frequency for which the electrical machine is designed. According to one embodiment, the metal foil surrounds between 10% and 25% of the circumference of the electrical machine.

Figure 9:
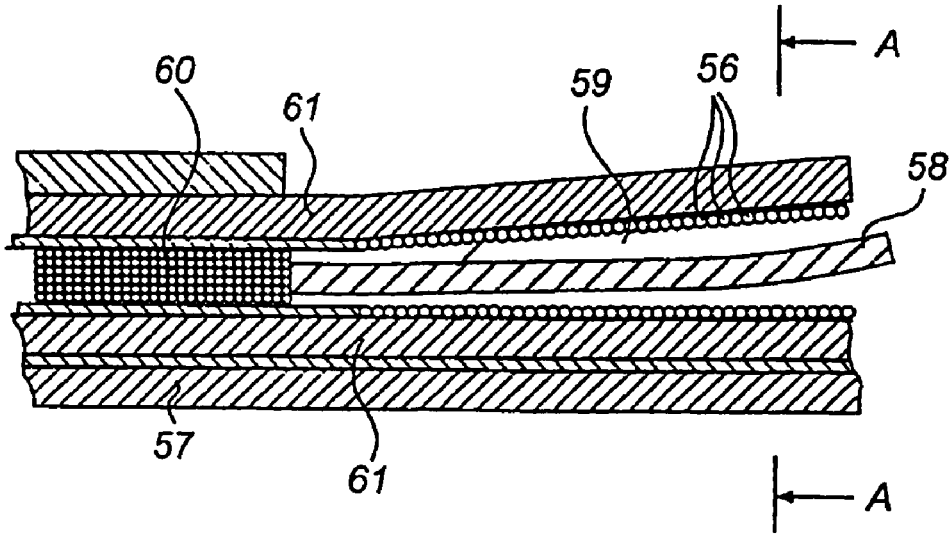
FIG. 9 shows the connection of a cable to an electrical machine according to an alternative embodiment of the present invention when the field-equalizing member only comprises a sub-member.
Figure 10:
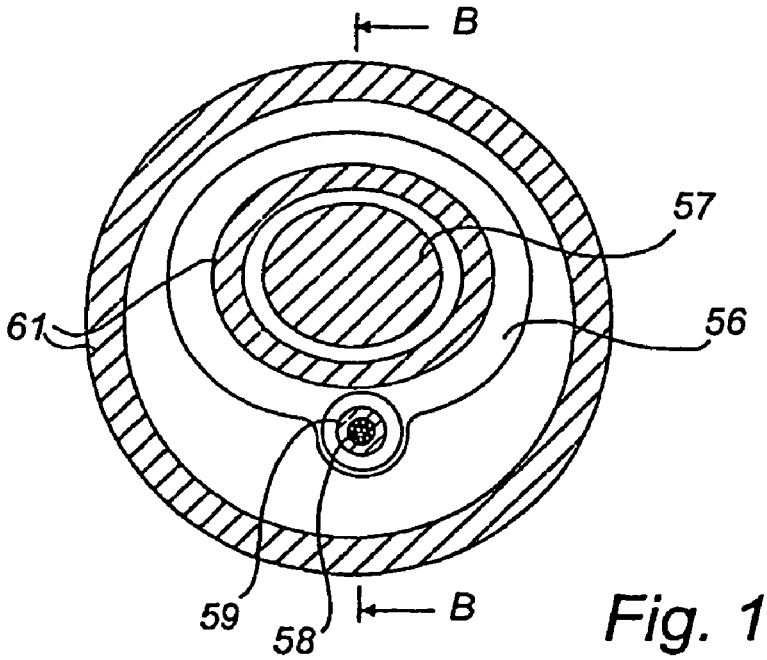
FIG. 10 shows the connection of a cable to an electrical machine according to an alternative embodiment of the present invention.

FIGS. 9 and 10 schematically show an electrical machine according to one embodiment of the invention with only one field-equalizing member in the form of a lacquered wire 56 wound around both the core 57 and the cable consisting of a conductor 58 and an insulation 59. FIG. 9 shows the section designated B—B in FIG. 10. FIG. 10 shows the section designated A—A in FIG. 9. On both sides of the high-voltage winding 60, insulating layers 61 are provided. The field-equalizing member runs two turns around the cable for each turn it runs around the core.

Figure 11:
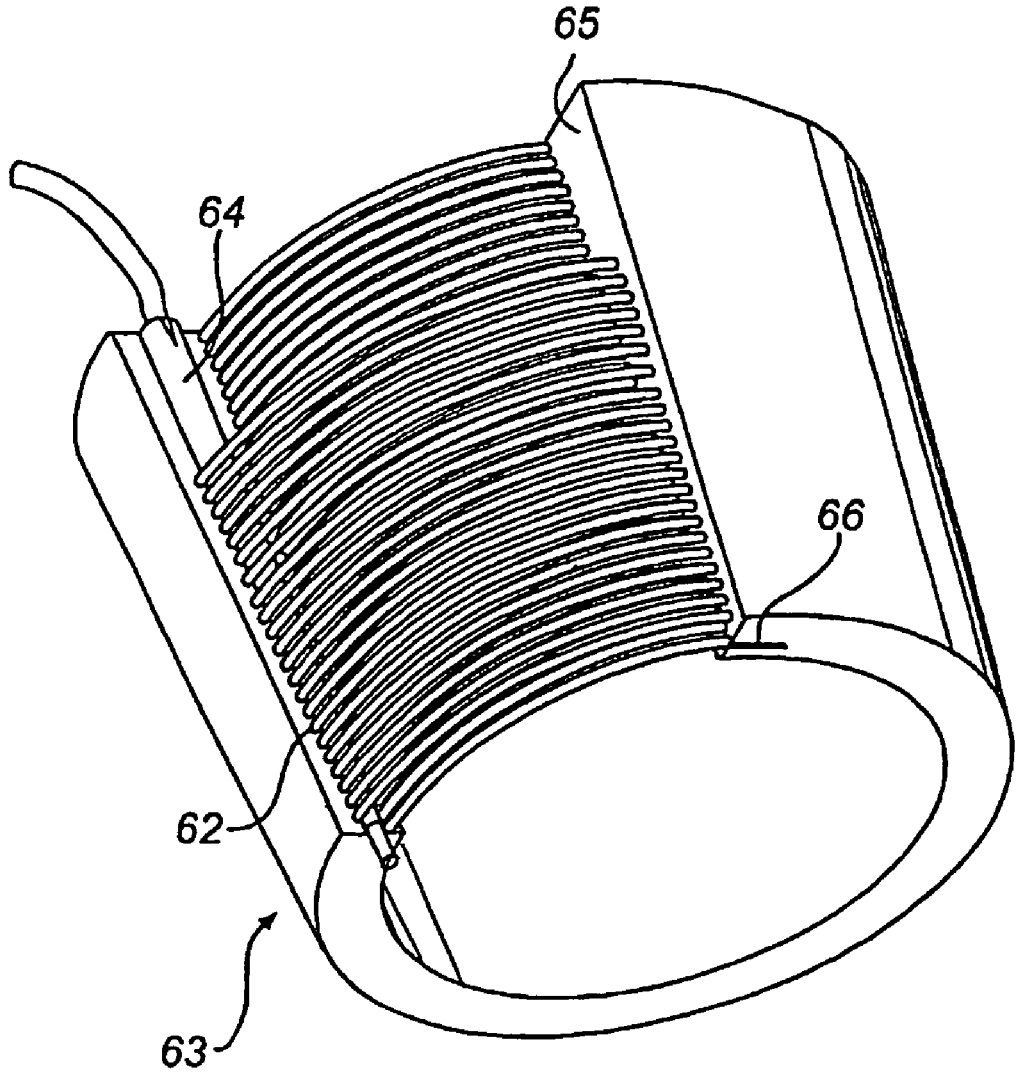
FIG. 11 shows an embodiment of the present invention, wherein the field-equalizing member constitutes one unit with the cable.

FIG. 11 shows an embodiment of the present invention, in which the field-equalizing member 62 in the form of a winding forms one unit 63 with the cable 64. The cable is inserted into an insulating sleeve 65 in which the field-equalizing member is integrated in the form of a winding 62. The end 66 of the wire that constitutes the winding 62 is exposed at that end of the sleeve which is intended to be in contact with the high-voltage winding. This means that the field-equalizing member may be brought into contact with the high-voltage winding.

The embodiments described above are only to be regarded as examples. A person skilled in the art should realize that the above embodiments may vary in a number of ways without departing from the inventive concept. For example, the soot particles need not be used in the semiconducting layers. Alternatively, other substances, such as metal oxides, may be used instead.

The slit in the tube need not, of course, extend transversely but may pass straight through the tubular wall.

The flux shield need not be of aluminium but may be of any other non-magnetic material, such as copper.

If a material other than aluminium is used in a flux shield in the form of said tube, a foil of this other material is advantageously used to surround the tube.

The invention claimed is:

1. An electrical machine comprising a core of a magnetic material, a first insulating layer of a solid electrically insulating material surrounding the core, a high-voltage winding in the form of an electric conductor wound around a first part of the first insulating layer, a field-equalizing member arranged around a second part of the first insulating layer and a second insulating layer of a solid electrically insulating material surrounding the high-voltage winding and the field-equalizing member, wherein the field-equalizing member comprises at least a first sub-member in the form of a winding, wherein an electric cable conductor is intended to be connected to the high-voltage winding at the field-equalizing member.

2. The electrical machine according to claim 1, wherein the field-equalizing member comprises a first and a second sub-member in the form of windings.

3. The electrical machine according to claim 2, wherein the first sub-member is wound so that it adjoins the outside of the first insulating layer, and wherein the second sub-member is wound so that it adjoins the inside of the second insulating layer.

4. The electrical machine according to claim 2, wherein said first and second sub-members are individually connected to a ground connection at one end.

5. The electrical machine according to claim 2, wherein said first and second sub-members are individually connected to the high-voltage winding at one end.

6. The electrical machine according to claim 2, wherein said first and second sub-members are individually connected to a ground connection at a first end and to the high-voltage winding at a second end.

7. The electrical machine according to claim 2, wherein the field-equalizing member is inductive.

8. The electrical machine according to claim 7, wherein the number of winding turns for said first and second sub-members is different.

9. The electrical machine according to claim 7, wherein the number of winding turns for said first and second sub-members is chosen so that the voltage induced across each of the sub-members is the same as across the high-voltage winding when an alternating voltage is applied to the high-voltage winding.

10. The electrical machine according to claim 2, wherein said first and second sub-members each comprise a lacquered wire.

11. The electrical machine according to claim 2, wherein the field-equalizing member is capacitive.

12. The electrical machine according to claim 11, wherein said first and second sub-members each comprise a tape that is wound in overlapping turns so that a capacitive coupling is formed between each turn.

13. The electrical machine according to claim 12, wherein the tapes are wound so that an essentially linear voltage distribution over the length of the sub-members is obtained.

14. The electrical machine according to claim 12, wherein the tapes comprise an insulating film and a semiconducting film.

15. The electrical machine according to claim 12, wherein the tapes comprise a metallized film with regular interruptions in the metallization in a longitudinal direction of the film.

16. The electrical machine according to claim 1, further comprising a flux-shielding member for controlling a magnetic flux in the core, said flux-shielding member surrounding the core.

17. The electrical machine according to claim 16, wherein the flux-shielding member is provided between the core and the first insulating layer.

18. The electrical machine according to claim 17, wherein the flux-shielding member is provided between the core and the first semiconducting layer.

19. The electrical machine according to claim 16, wherein the flux-shielding member comprises a tube of an electrically conducting non-magnetic material, in which tube induced currents are formed which prevent the flux from leaking out of the core so that an essentially linear voltage distribution is obtained across the core.

20. The electrical machine according to claim 19, wherein said tube has a slit along a longitudinal axis for the core to avoid short-circuiting of the electrical machine.

21. The electrical machine according to claim 20, wherein a slit-insulating film is arranged in said slit and an aluminum foil is arranged above said slit and slit-insulating film, the aluminum foil being in contact with the tube on one side of the slit.

22. The electrical machine according to claim 19, wherein said tube is aluminum.

23. Use of an electrical machine according to claim 1 as a transformer for transformation of high-voltage into mains voltage.

24. The use according to claim 23, in applications with high-voltage direct current.

25. The electrical machine according to claim 1, further comprising an electric cable conductor that is surrounded by a third insulating layer of an electrically insulating material, said cable conductor being connected to the high-voltage winding and partly arranged between the first and second insulating layers.

26. The electrical machine according to claim 1, wherein the field-equalizing member is inductive.

27. The electrical machine according to claim 1, wherein the field-equalizing member is capacitive.

28. Use of an electrical machine according to claim 1, operating under a square voltage.

29. The electrical machine according to claim 1, further comprising a first semiconducting layer that is in contact with and is surrounded by the first insulating layer, a second semiconducting layer provided between the first insulating layer and the high-voltage winding in contact with both the first insulating layer and the high-voltage winding, a third semiconducting layer provided between the second insulating layer and the high-voltage winding in contact with both the second insulating layer and the high-voltage winding, and a fourth semiconducting layer that is in contact with and surrounds the second insulating layer.

30. Use of an electrical machine according to claim 1, in a reactor for equalizing a voltage.

* * * * *